United States Patent [19]

Rao

[11] Patent Number: 4,899,772

[45] Date of Patent: Feb. 13, 1990

[54] MIXING AIDS FOR SUPERSONIC FLOWS

[75] Inventor: Gadicherla V. R. Rao, Thousand Oaks, Calif.

[73] Assignee: Rockwell International Corporation, El Segundo, Calif.

[21] Appl. No.: 260,221

[22] Filed: Oct. 20, 1988

[51] Int. Cl.[4] ..... B01F 5/00

[52] U.S. Cl. ..... 137/1; 137/896

[58] Field of Search ..... 137/808, 809, 811, 896, 137/1

[56] References Cited

U.S. PATENT DOCUMENTS 4,498,786 2/1985 Ruscheweyh ..... 137/896 X
4,521,117 6/1985 Ouwerkerk ..... 137/896 X

OTHER PUBLICATIONS

Rao, G. V. R., "Analysis of a New Concept Rocket Nozzle", ARS Semi-Annual Meeting & Astronautical Exposition, Los Angeles, CA 5/9/60.

*Primary Examiner*—Robert G. Nilson
*Attorney, Agent, or Firm*—H. Fredrick Hamann; Harry B. Field; David C. Faulkner

[57] ABSTRACT

A method and apparatus for injecting a secondary supersonic stream into a primary supersonic stream. A secondary flow nozzle is designed to contain non-uniformities so as to produce stream-wise vortices. The primary supersonic flow is allowed to flow over a ramp surrounding the secondary nozzle. At the aft end of the ramp, stream-wise vortices appear in the primary flow rotating in the same direction as the vortices in the secondary stream. As a consequence, the vortex strength is increased, leading to enhanced entrainment in mixing of the two streams.

7 Claims, 2 Drawing Sheets

MIXING AIDS FOR SUPERSONIC FLOWS

BACKGROUND OF THE INVENTION

The present invention relates to mixing aids for supersonic gas flows. More specifically, this invention relates to mixing aids which provide pressure differentials and resulting optimal flow vortices within the gas flows which are to be mixed thereby enhancing mixing of the flows.

The need for enhancing the mixing of supersonic gas flows is becoming increasingly more important with the development of combined-cycle engines, more advanced rocket engines and chemical laser systems.

In the past, rocket engines typically utilized impinging injection schemes for thrust vector control involving injection of a supersonic secondary fluid flow in a direction normal or nearly normal to a supersonic primary fluid flow. However, such injection schemes do not provide production of thrust, from supersonic secondary flow, which is required in modern combined-cycle and advanced rocket engines.

Other injection schemes include a secondary stream being parallel to the primary stream, with the mixing of the streams governed only by the velocity differential between the streams. However, these schemes do not induce entrainment of one stream into the other in short distances.

OBJECTS OF THE INVENTION

It is the principal object of the present invention, therefore to provide a method and apparatus for optimizing the mixing of supersonic gas flows.

It is another object to minimize the duct length in which the gas flows are mixed, to maximize the thrust created by the mixing propellants and to minimize the friction losses.

It is yet another object to prevent any potential choking in the supersonic flows.

Other objects, advantages and novel features of the present invention will become apparent from the following detailed description of the invention when considered in conjunction with the accompanying drawing.

SUMMARY OF THE INVENTION

The present invention is an apparatus and method for optimizing the mixing of supersonic gas flows. In its broadest aspects, the invention includes flowing a supersonic primary gas flow within a duct in a direction substantially parallel to the duct axis. A portion of the primary gas flow is diverted away from a primary duct sidewall of the duct. The primary duct sidewall extends in a direction substantially parallel to the duct axis. Therefore, relatively high pressure zones and relatively low pressure zones are formed within the primary gas flow which result in the formation of primary flow vortices within the primary gas flow. The primary flow vortices have axes parallel to the duct axis. A secondary gas flow is introduced into the duct at a location adjacent to where the primary gas flow is diverted. The secondary gas flow has relatively high pressure zones and relatively low pressure zones which are so arranged to result in the formation of secondary flow vortices having axes parallel to the duct axis and being located adjacent to and having the same sign of the primary flow vortices. The relatively low pressure zones within the secondary gas flow have a lower pressure than the relatively low pressure zones within the primary gas flow. Furthermore, the relatively high pressure zones within the secondary gas flow have a higher pressure than the relatively high pressure zones within the primary gas flow. The interaction of the primary flow vortices and the secondary flow vortices result in enhanced mixing of the primary and secondary gas flows.

BRIEF DESCRIPTION OF THE DRAWINGS

The same elements or parts throughout the figures of the drawings are designated by the same reference characters.

DETAILED DESCRIPTION OF THE INVENTION

Figure 1:
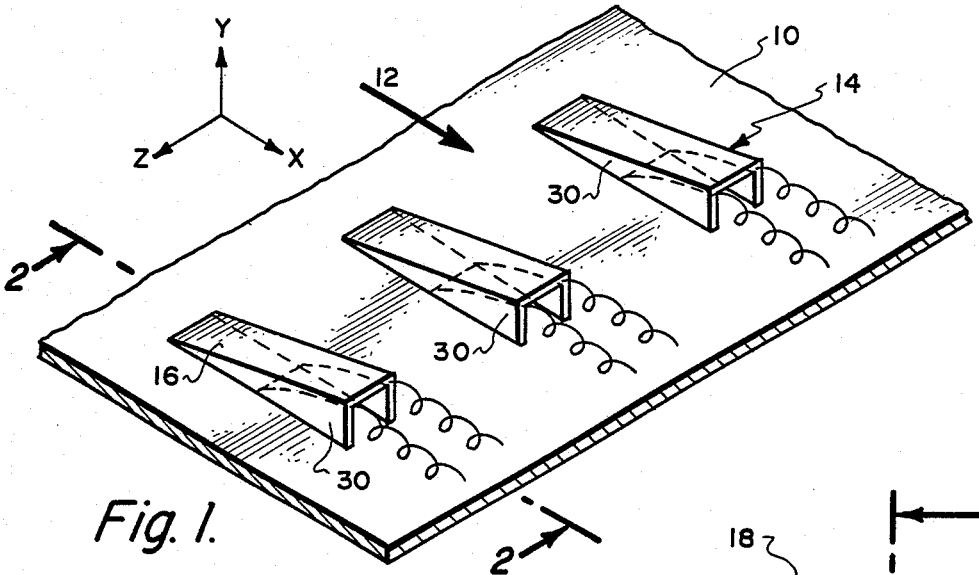
FIG. 1 is a perspective view of the mixing enhancement apparatus of the present invention.

Referring to the drawings and to the characters of reference marked thereon, FIG. 1 illustrates a portion of a side wall 10 of a primary duct within which a supersonic primary gas flows, as denoted by arrow 12. In the case of an ejector, the primary gas flow may be, for example, a laser exhaust. In the case of a rocket or combined-cycle engine the primary gas flow would be an oxidizer. In any event, the primary gas flow should be in a direction essentially parallel to the duct axis, x, shown in FIG. 1. The primary duct side wall 10 has ramped elements or wedges generally designated 14 attached thereon. Each ramped element 14 includes a gas deflection side 16 which extends within the primary duct side wall 10.

Figure 2:
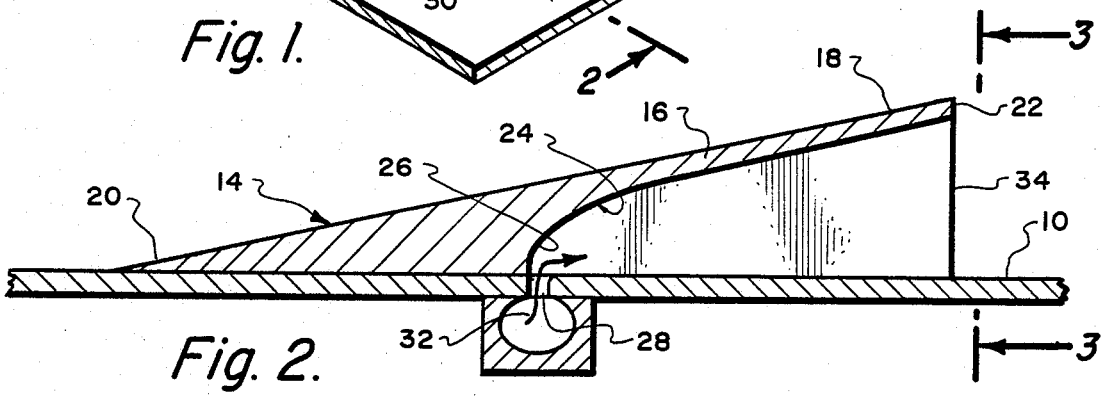
FIG. 2 is a cross-sectional view of a ramped element taken along line 2—2 of FIG. 1.

Referring now to FIG. 2, the gas deflection side 16 includes an outer deflection surface 18 with an upstream leading edge 20 which is adjacent and attached to the side wall 10. The outer deflection surface 18 is substantially flat and tilted away from the primary duct side wall 10 so that the downstream edge 22 is located a distance away from the primary duct side wall 10. The gas deflection side 16 also includes a curved, inner deflection surface 24. The upstream end 26 of the curved, inner deflection surface 24 is adjacent to an orifice 28 formed in the side wall 10. The triangular ends 30 of the ramped elements or wedges 14 are on planes parallel to the x-direction (see FIG. 1). The inner deflection surface 24, ends 30 and the portion of the primary duct side wall 10 which is covered by the ramp 14 together form an expansion-deflection type nozzle. As that term is used herein, an expansion-deflection nozzle is the type referred to in the paper entitled, "Analysis of a New Concept Rocket Nozzle" by the present applicant. G. V. R. Rao, presented at the ARS Semi-Annual Meeting and Astronautical Exposition, Los Angeles, California May 9–12, 1960. Briefly, the expansion deflection nozzle consists of an outwardly oriented orifice throat and a wall contour to deflect the exhaust gases into a near axial direction. Since the expansion of the exhaust gases occurs around the corner of the orifice (throat) and the flow is deflected by a wall contour, this type of nozzle is designated an "Expansion-Deflection" type. A method of designing nozzle wall contour to yield optimum thrust is described in the cited paper and typical results are presented.

Specifically, with reference to the subject application, during operation, a secondary gas flow is introduced through the orifice 28 as illustrated by arrow 32. (The orifice 28 is formed by a slit in the sidewall 10.) The flow 32 is deflected against inner surface 24 and is directed out of the outlet 34 in a direction substantially parallel to the duct axis x.

Figure 3:
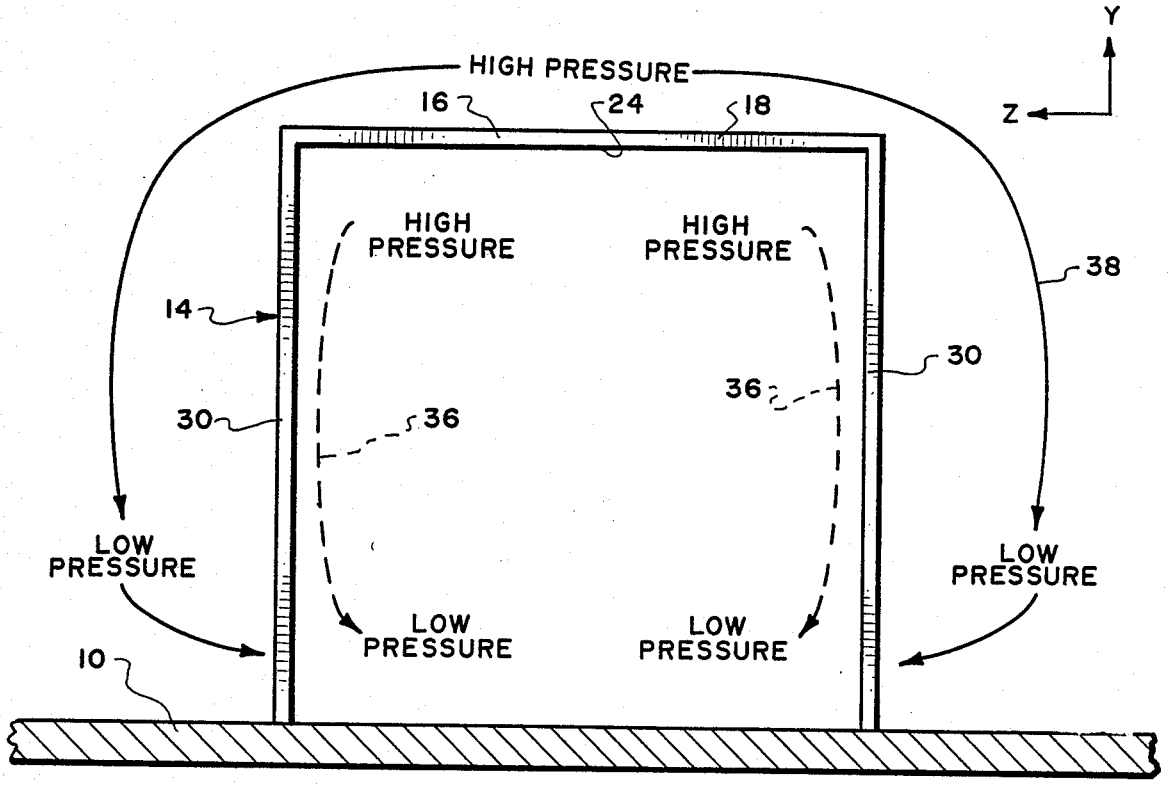
FIG. 3 is an end view of a ramped element.

As illustrated in FIG. 3, relatively high pressure zones are created in the expansion-deflection nozzle adjacent the inner deflection surface 24 while relatively low pressure zones are created adjacent the primary duct side wall 10. As a consequence, secondary flow vortices, designated 36, are established having axes which are parallel to the duct axis x. Deflection of the primary gas flow around the outer deflection surface 18 results in the formation of relatively high pressure zones adjacent the outer deflection surface 18 and low pressure zones adjacent the sides 30 of the wedge 14. Thus, primary flow vortices, designated 38, are established having axes which are parallel to the duct axis x. Factors such as the direction of the flow 32 through the orifice 28 (see FIG. 2) and the contour of the inner deflection surface are coordinated so as to yield low pressure zones within the primary flow having higher pressures than the low pressure zones within the secondary gas flow. Furthermore, the high pressure zones within the primary flow have lower pressures than the high pressure zones within the secondary gas flow. Therefore, enhanced mixing is established.

Obviously, many modifications and variations of the present invention are possible in light of the above teachings. It is therefore to be understood that, within the scope of the appended claims, the invention may be practiced otherwise than as specifically described.

Figure 4:
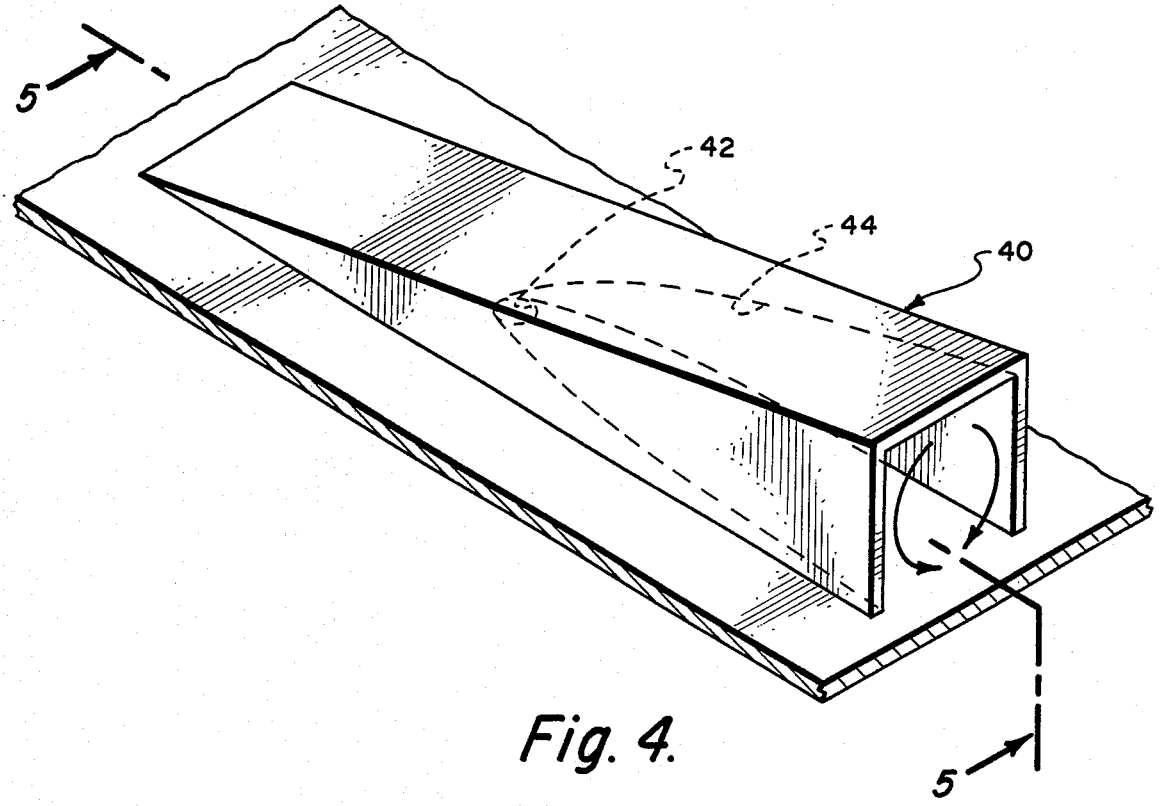
FIG. 4 is a perspective view of an alternate embodiment of a ramped element.

For example, an alternate embodiment of a ramped element is illustrated in FIG. 4. generally designated 40. A circular orifice 42 is utilized in this embodiment. Furthermore, the interior contoured nozzle surface of FIG. 2 is replaced by a three-dimensional surface 44 as shown in FIG. 4. The three-dimensional surface 44 guides the secondary flow through the nozzle and to a square cross-section exit at supersonic velocities.

Figure 5:
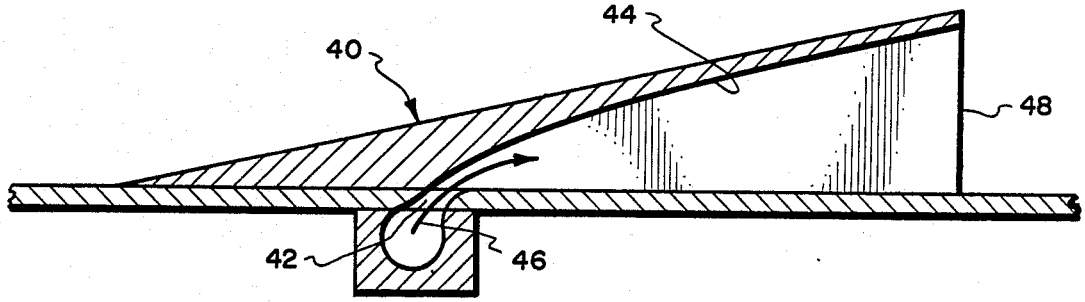
FIG. 5 is a cross-sectional view of the alternate embodiment of the ramped element of FIG. 4 taken along line 5—5 of that Figure.

FIG. 5 shows a cross-sectional view along the centerline of the ramped element of FIG. 4. The direction of the flow 46 causes non-uniformity at exit section 48. This alternate design improves the fabricability and structural integrity of the interior surface of the ramped element. The mixing of the supersonic primary and supersonic secondary streams is maintained unaltered by the use of this alternate design.

Although the illustrated embodiments show a ramped element with a square or rectangular exit portion, it is understood that other cross-sectional shapes may be utilized without detracting from the teaching of the present invention.

What is claimed and desired to be secured by Letters Patent of the United States is:

1. A method for mixing a supersonic primary gas flow and a supersonic secondary gas flow within a duct which extends along an axis, comprising the steps of:

(a) flowing said primary gas flow within said duct in a direction substantially parallel to said duct axis;

(b) diverting a portion of said primary gas flow way from a primary duct side wall of said duct, said primary duct side wall extending in a direction substantially parallel to said duct axis, and thereby forming relatively high pressure zones and relatively low pressure zones within said primary gas flow which result in the formation of primary flow vortices within said primary gas flow, said primary flow vortices having axes parallel to said duct axis; and (c) introducing said secondary gas flow into said duct at a location adjacent to where said primary gas flow is diverted, said secondary gas flow having relatively high pressure zones and relatively low pressure zones which are so arranged to result in the formation of secondary flow vortices having axes parallel to said duct axis and being located adjacent to and having the same sign of said primary flow vortices, the relatively low pressure zones within the secondary gas flow having a lower pressure than the relatively low pressure zones within the primary gas flow, the relatively high pressure zones within the secondary gas flow having a higher pressure than the relatively high pressure zones within the primary gas flow, the interaction of said primary flow vortices and said secondary flow vortices resulting in enhanced mixing of said primary and said secondary gas flows.

2. The method of claim 1 wherein the introduction of said secondary gas flow into said duct comprises the steps of:

(a) directing said secondary gas flow through an inlet of an expansion-deflection nozzle extending within said primary duct side wall, said secondary flow being directed through said inlet in a direction substantially normal to said duct axis;

(b) directing said secondary gas flow through said expansion-deflection nozzle, said expansion-deflection nozzle having a gas deflection side extending within said primary duct side wall for separating said primary gas flow from said secondary gas flow, said gas deflection side including a curved, inner deflection surface, said relatively high pressure zones within said secondary gas flow being formed adjacent said curved, inner deflection surface and said relatively low pressure zones within said secondary gas flow being formed at a section of said nozzle adjacent said primary duct side wall; and (c) directing said secondary flow through an outlet of said expansion-deflection nozzle in fluid communication with said primary gas flow, said secondary flow being directed out of said expansion-deflection nozzle in a direction substantially parallel to said duct axis.

3. The method of claim 2 wherein said diverted portion of said primary gas flow is diverted away from said primary duct side wall by directing it around a substantially flat, outer deflection surface of said gas deflection side, an upstream leading edge of said outer deflection surface being attached to said primary duct side wall, said outer deflection surface being tilted away from said primary duct side wall so that a downstream edge is located a distance away from said primary duct side wall, the diverted portion of said primary gas flow thereby having a higher pressure than the undiverted portion of said primary gas flow.

4. An apparatus for enhancing the mixing of supersonic gas flows, comprising:

(a) a duct having an axis and a primary duct side wall extending in a direction substantially parallel to said axis, said duct for containing a primary gas flow which flows in a direction substantially parallel to said axis; and (b) means for diverting a portion of said primary gas flow away from said primary duct side wall and for introducing a secondary gas flow into said duct at a location adjacent to where said primary gas flow is diverted, said means for diverting for forming relatively high pressure zones and relatively low pressure zones within said primary gas flow which result in the formation of primary flow vortices within said primary gas flow, said primary flow vortices having axes parallel to said duct axis, said secondary gas flow having relatively high pressure zones and relatively low pressure zones which are so arranged to result in the formation of secondary flow vortices having axes parallel to said duct axis and being located adjacent to and having the same sign of said primary flow vortices, the relatively low pressure zones within the secondary gas flow having a lower pressure than the relatively low pressure zones within the primary gas flow, the interaction of said primary flow vortices and said secondary flow vortices resulting in enhanced mixing of said primary and said secondary gas flows.

5. The apparatus of claim 4 wherein said means for diverting said primary gas flow and for introducing said secondary gas flow includes an expansion-deflection nozzle extending within said primary duct side wall, said expansion-deflection nozzle including:

(a) an inlet in fluid communication with a source of secondary gas, said inlet extending through said primary duct side wall, said secondary flow being directed through said inlet in a direction substantially normal to said duct axis;

(b) a gas deflection side extending within said primary duct side wall for separating said primary gas flow from said secondary gas flow said gas deflection side including a curved, inner deflection surface located downstream said inlet, said relatively high pressure zones within said secondary gas flow being formed adjacent said curved, inner deflection surface and said relatively low pressure zones within said secondary gas flow being formed in a section of said nozzle adjacent said primary duct side wall; and (c) an outlet in fluid communication with said primary gas flow, said secondary gas flow being directed out of said expansion-deflection nozzle in a direction substantially parallel to said duct axis.

6. The apparatus of claim 5 wherein said outlet has a rectangular cross section.

7. An apparatus for enhancing the mixing of a primary gas flow and the secondary gas flow, comprising:

a duct having an axis and a primary duct side wall extending in a direction substantially parallel to said axis, said duct for containing a primary gas flow which flows in a direction substantially parallel to said axis; and a ramped element attached to said primary duct side wall for covering a portion of the primary duct side wall, said ramped element including a gas deflection side having a relatively flat, outer deflection surface with an upstream leading edge being attached to said primary duct side wall, said outer deflection surface being tilted away from said primary duct side wall so that a downstream edge is located a distance away from said primary duct side wall, said outer deflection surface for diverting a portion of said primary gas flow away from the primary duct side wall, the portion of the primary gas flow being diverted having a relatively higher pressure than a portion of the primary gas flow which is not diverted and thereby resulting in the formation of primary flow vortices downstream said ramped element having axes parallel to said duct axis, said ramped element further including two flat ends, each end having a triangular external surface and an internal surface, said flat ends for connecting the outer deflection surface of the ramp to the primary duct side wall, said gas deflection side further including a curved, inner deflection surface, said curved inner deflection surface, the two internal surfaces of the ramped element and said covered portion of said primary duct side wall forming an expansion-deflection nozzle, an inlet for said expansion-deflection nozzle being formed by an orifice in the covered portion of said primary duct side wall adjacent an upstream end of said curved, inner deflection surface, wherein during operation, the secondary gas flows through said inlet of the expansion-deflection nozzle at an angle substantially normal to said duct axis, through said expansion deflection nozzle and out the downstream end of said ramped element, relatively high pressure zones within said secondary gas flow being formed in a section of said expansion deflection nozzle adjacent said curved inner deflection surface and relatively low pressure zones within said secondary gas flow being formed in a section of the expansion-deflection nozzle adjacent the covered portion of the primary duct side wall, thereby forming secondary flow vortices having axes parallel to said duct axis, the relatively low pressure zones within the secondary gas flow having a lower pressure than the relatively low pressure zones within the primary gas flow, the relatively high pressure zones within the secondary gas flow having a higher pressure than the relatively high pressure zones within the primary gas flow, the arrangement of the primary and secondary flow vortices thereby resulting in enhanced mixing.

* * * * *